US005555653A

United States Patent [19]

Morgan

[11] Patent Number: 5,555,653

[45] Date of Patent: Sep. 17, 1996

[54] CRAFT HOOP ASSEMBLY

[76] Inventor: Robert E. Morgan, 2255 NE. Porter Rd., Blue Springs, Mo. 64014

[21] Appl. No.: 546,559

[22] Filed: Oct. 20, 1995

Related U.S. Application Data

[63] Continuation-in-part of Ser. No. 379,889, Jan. 27, 1995, abandoned.

[51] Int. Cl.[6] ..... D06C 3/08

[52] U.S. Cl. ..... 38/102.2

[58] Field of Search ..... 38/102, 102.1, 38/102.2, 102.91; 101/127.1; 156/229; 160/371, 374.1, 380, 382, 402

[56] References Cited

U.S. PATENT DOCUMENTS

| | | | |
|---|---|---|---|
| 627,821 | 6/1899 | Gurnee | 38/102.2 |
| 699,263 | 5/1902 | Vosler | 38/102.2 |
| 758,535 | 4/1904 | Howden | 38/102.2 |
| 879,654 | 2/1908 | Kohler | 38/102.2 |
| 928,598 | 7/1909 | Gibbs | 38/102.2 |
| 935,841 | 10/1909 | Fife | 38/102.2 |
| 989,597 | 4/1911 | Gibbs | 38/102.2 |
| 1,010,534 | 12/1911 | Totten et al. | 38/102.2 |
| 1,229,857 | 6/1917 | Alyea | 38/102.2 |
| 1,248,783 | 12/1917 | Andrews | 38/102.2 |
| 1,332,395 | 3/1920 | Hachmann | 384/296 |
| 1,574,364 | 2/1926 | Carlson | 38/102.2 |
| 2,063,901 | 12/1936 | Wicander | 160/179 |
| 2,198,128 | 4/1940 | Roberts et al. | 38/102.2 |
| 3,520,224 | 7/1970 | Hensley et al. | 411/512 |
| 3,729,045 | 4/1973 | MacDonald | 160/371 |
| 3,855,751 | 12/1974 | Parsons et al. | 38/102.2 |
| 3,885,751 | 5/1975 | Kelch et al. | 242/74.1 |
| 3,950,869 | 4/1976 | Samarin | 38/102.91 |
| 4,357,885 | 11/1982 | Stockton | 112/103 |
| 4,432,381 | 2/1984 | Greenbaum | 135/87 |
| 4,451,997 | 6/1984 | Jones | 38/102.2 |
| 4,485,574 | 12/1984 | Bennetot | 38/102.2 |
| 4,558,904 | 12/1985 | Schultz | 160/402 |
| 4,571,864 | 2/1986 | Bopp | 38/102.91 X |
| 4,644,629 | 2/1987 | Moore, III | 38/102.2 X |
| 4,644,639 | 2/1987 | Atteberry et al. | 38/102.2 X |
| 4,658,522 | 4/1987 | Kramer | 38/102.91 |
| 4,723,367 | 2/1988 | Samoilov et al. | 38/102.2 |
| 4,860,467 | 8/1989 | Larson | 38/102.91 |

FOREIGN PATENT DOCUMENTS

| | | |
|---|---|---|
| 1957248 | 5/1971 | Germany . |

*Primary Examiner*—Ismael Izaguirre
*Attorney, Agent, or Firm*—Litman, McMahon and Brown, L.L.C.

[57] ABSTRACT

A craft hoop assembly for securing material on which a craft is to be performed comprises an inner hoop or ring having an outer surface and a split outer hoop or ring having an inner surface which is positionable in circumscribing alignment with the inner ring such that the inner surface of the outer ring generally abuts against the outer surface of the inner ring. An elastic band or o-ring positioned within a groove formed in and extending circumferentially or in circumscribing alignment with the outer surface of the inner ring. A portion of the elastic band, in the form of a loop, is extended through a hole in the ring along the groove. A pin is inserted in the loop to prevent the loop from retracting back through the hole which secures the elastic band to the ring. Material to be secured between the rings is positioned over the inner ring and the outer ring is then positioned over the inner ring. A clamp on the outer ring is then adjusted to reduce the diameter of the outer ring to generally compress the material on which the craft is to be performed between the inner and outer rings and in particular, to compress the material between the elastic band and the inner surface of the outer ring.

14 Claims, 2 Drawing Sheets

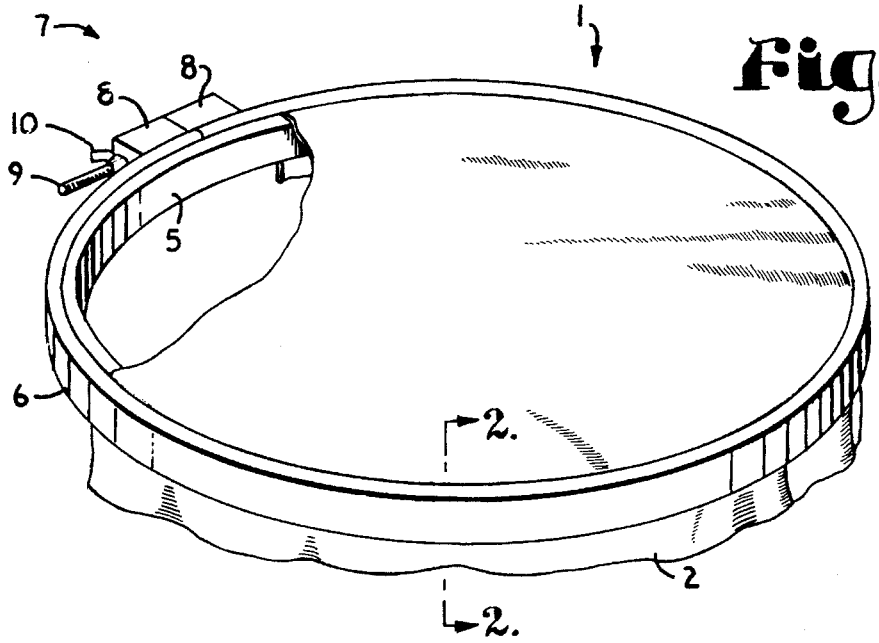
Fig.1.
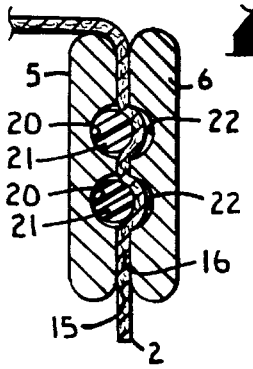
Fig.2.
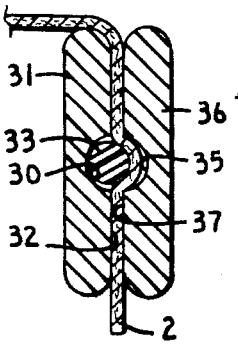
Fig.3.
Fig.4.
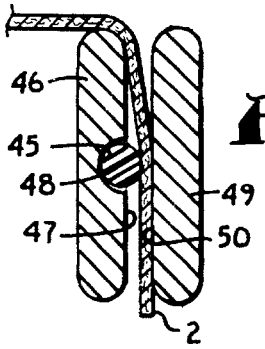
Fig.5.
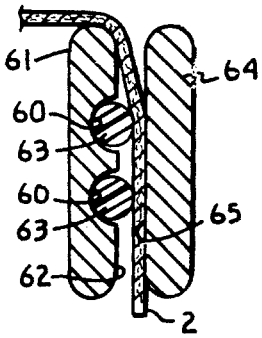
Fig.6.
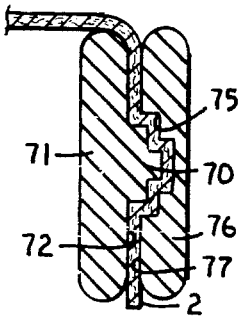

Fig.7.
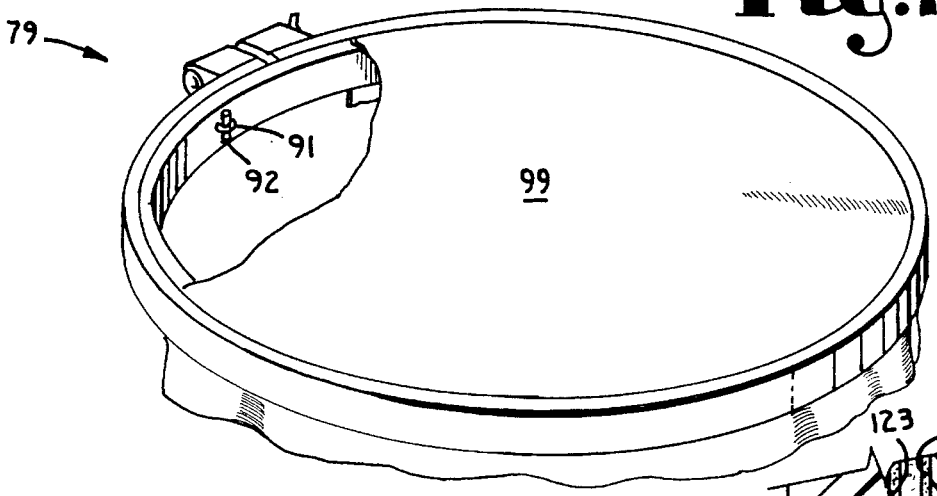
Fig.12.
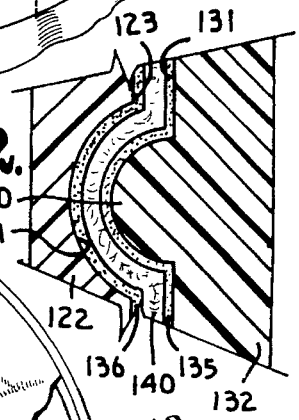
Fig.8.
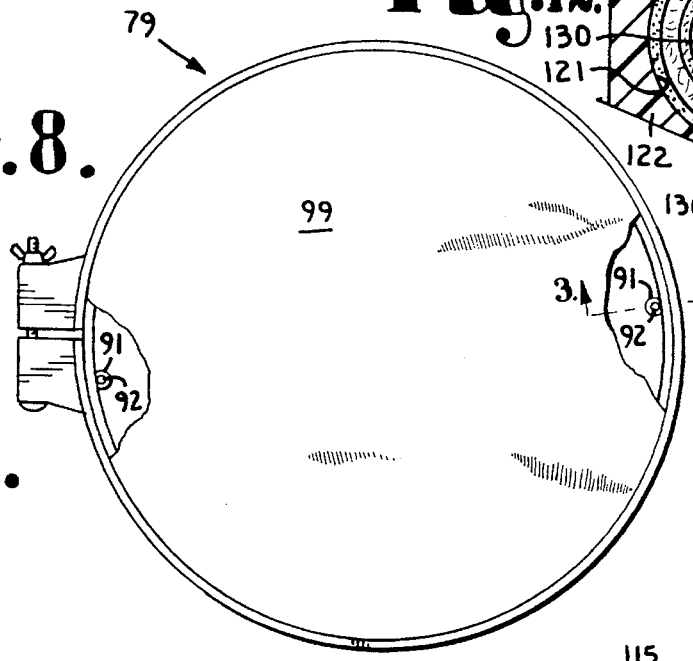
Fig.9.
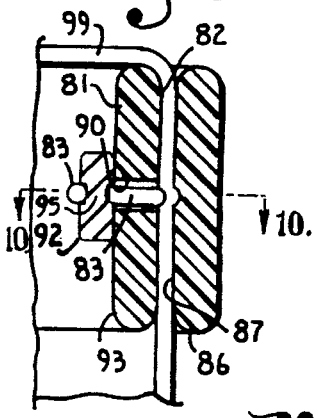
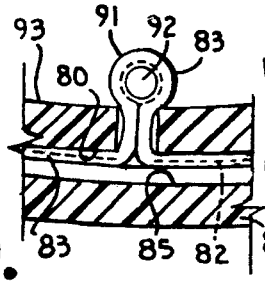
Fig.10.
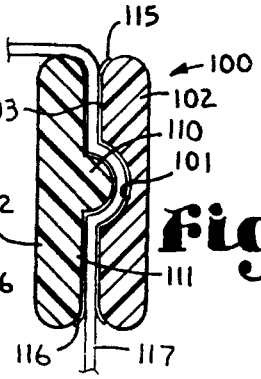
Fig.11.

CRAFT HOOP ASSEMBLY

CROSS REFERENCE TO RELATED APPLICATIONS

This application is a continuation-in-part of application Ser. No. 08/379,889, now abandoned, entitled IMPROVED CRAFT HOOP ASSEMBLY, filed Jan. 27, 1995.

BACKGROUND OF THE INVENTION

The present invention relates to craft hoops and more particularly to a craft hoop incorporating structure to more securely hold fabric secured by the craft hoop.

Craft hoops of the prior art generally comprise concentric inner and outer rings. The inner ring has a fixed diameter and the outer ring has an adjustable diameter. Material upon which a craft is to be performed is placed across the inner ring. The outer ring is then placed over the material and around the inner ring and the diameter of the outer ring is then adjusted such that the outer ring fits snugly against the material and inner ring so as to hold the material between the two rings. Craft work is then performed on the material held taut between the two rings.

The rings of most craft hoops on the market have smooth abutting surfaces between which the fabric is secured. Pulling and pressing on the fabric while performing a craft causes the fabric to slide between the rings. Recognizing this problem, several attempts have been made to increase the grip on the fabric by making the abutting surfaces of the inner and outer hoops irregular and by securing strips of resilient, flexible material to one or more of the rings. The strips of flexible material such as felt or leather have been secured to the ring by gluing. The gluing process is labor intensive and the adhesive bond often deteriorates relatively quickly. U.S. Pat. No. 758,535 to Howden shows a craft hoop having an elastic cord positioned in a recess or groove in the inner ring of a craft hoop assembly. The recess is particularly shaped to retain the ring in the recess during use, however the specific shape of the groove would be relatively complicated to machine into a hoop and results in relatively limited contact between the material secured between the rings and the flexible cord.

Although wooden hoops have been extremely popular, the escalating cost of wood has increased demand for hoops made of alternative materials such as plastic. Plastic hoops generally provide even less frictional resistance than wooden hoops. Therefore the demand and need for effective yet inexpensive means for securing or gripping material between such hoops has increased. Currently available systems have failed to meet this need.

SUMMARY OF THE INVENTION

The present invention generally comprises an improved craft hoop assembly for securing material on which a craft is to be performed. The craft hoop assembly comprises an inner hoop or ring having an outer surface and a split outer hoop having an inner surface. The outer ring includes an inner surface and is positionable in circumscribing alignment with the inner ring such that the inner surface of the outer ring generally abuts against the outer surface of the inner ring. The craft hoop assembly includes griping means for more firmly securing material positioned between the inner and outer rings. The gripping means generally comprises an elastic band or o-ring positioned within a groove formed in and extending circumferentially or in circumscribing alignment with the outer surface of the inner ring. In one embodiment, at least one bore extends through the inner ring. A portion of the elastic band is pushed through the bore to form a loop extending through the ring into the area circumscribed by the ring. A pin, whose length is greater than the diameter of the bore is placed in the loop against the biasing force of the band which biases the pin against an inner surface of the inner ring. The pin prevents the band from retracting through the bore.

Material to be secured between the rings is positioned over the inner ring, and the outer ring is then positioned over the inner ring. Clamping means on the outer ring is then adjusted to reduce the diameter of the outer ring to generally compress the material on which the craft is to be performed between the inner and outer rings and in particular, to compress the material between the elastic band and the inner surface of the outer ring.

It is foreseen that the craft hoop assembly may include more than one elastic band secured within multiple grooves. Further, a groove may be formed on and circumscribe the inner surface of the outer ring in such a manner that the groove on the outer ring generally encloses a portion of the elastic band extending beyond the outer surface of the inner ring when the outer ring is positioned in circumscribing alignment with the inner ring.

In another embodiment of the present invention a projection is integrally formed on either the inner surface of the outer ring or the outer surface of the inner ring. A corresponding groove is formed in the opposing surface of the inner or outer ring respectively. A spray on or brush on coating of friction enhancing material is applied to one or both of the inner ring outer surface or the outer ring inner surface to increase the gripping effect of the rings on fabric secured therebetween.

OBJECTS AND ADVANTAGES OF THE INVENTION

Therefore, it is an object of the invention to provide an improved craft hoop assembly that more effectively grips material secured between inner and outer rings of the craft hoop assembly; to provide such a craft hoop assembly that is relatively simple and inexpensive to manufacture; to provide such a craft assembly which is simple to use; and to provide such a craft hoop which is particularly well adapted for its intended usage.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a craft hoop assembly of the present invention with material on which a craft is to be performed secured thereto with portions broken away to show detail thereof.

FIG. 2 is an enlarged and fragmentary cross-sectional view taken along line 2—2 of FIG. 1.

FIG. 3 is a view similar to FIG. 2 showing an alternative embodiment thereof.

FIG. 4 is a view similar to FIG. 2 showing an alternative embodiment thereof.

FIG. 5 is a view similar to FIG. 2 showing an alternative embodiment thereof.

FIG. 6 is a view similar to FIG. 2 showing an alternative embodiment thereof.

FIG. 7 is a perspective view of an alternative embodiment of the craft hoop of the present invention with material on which a craft is to be performed shown secured thereto with portions broken away to show interior detail.

FIG. 8 is a top plan view of the embodiment as shown in FIG. 7 with portions of the material secured thereto broken away to show detail.

FIG. 9 is an enlarged and fragmentary cross-sectional view taken along line 9—9 of FIG. 8.

FIG. 10 is a fragmentary cross-sectional view taken along line 10—10 of FIG. 9.

FIG. 11 is a view similar to FIG. 9 showing an alternative embodiment of the present invention.

FIG. 12 is an enlarged and fragmentary view similar to FIG. 11 showing another embodiment of the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 refers to an improved craft hoop assembly of the present invention for use in securing thereto material 2 on which a craft is to be performed. The size of the assembly is variable to accommodate materials 2 from a wide range of crafts including: needlepoint, embroidery and quilting. The assembly comprises an inner ring or hoop 5 and a split outer ring or hoop 6. The rings or hoops 5 and 6 may be formed from wood, metal, rigid plastic or other fairly rigid materials.

The outer ring 6 includes clamping means such as clamp 7 for adjusting the diameter of the outer ring 6. Clamp 7, as shown, comprises a pair of opposed ears 8, each mounted on an end of the split outer ring 6, and also includes a bolt 9 extending through coaxial apertures in each ear 8 to be secured by a nut 10. The outer ring 6 is sized such that the outer ring 6 may be positioned in encircling or circumscribing alignment with the inner ring 5. Tightening of the nut 10 on the bolt 9 urges the ears 8 and the ends of the outer ring 6 together so as to reduce the diameter of the outer ring 6 and to generally constrict the outer ring 6 around the inner ring 5.

As best seen in FIG. 2, the inner ring 5 includes an outer surface 15 and the outer ring 6 includes an inner surface 16. A first pair of grooves 20, of semicircular cross-section, is formed in the inner ring 5 on the outer surface 15. The grooves 20 circumscribe the inner ring outer surface 15 in parallel and slightly spaced apart alignment. An elastic band or 0-ring 21, preferably of circular cross-section and having a diameter, in an unstretched state, which is slightly smaller than the diameter of the inner ring outer surface 15, is positioned within each of the grooves 20. The diameter of each groove 20 is slightly larger than the diameter of the cross-section of the elastic band 21 such that when an elastic band 21 is secured within one of the grooves 20 a portion, approximately half, of the band 21 extends beyond the inner ring outer surface 15.

A second pair of grooves 22 is formed in the outer ring 6 on the inner surface 16. The outer ring grooves 22 are generally the same size as the inner ring grooves 20 and are positioned to align with the inner ring grooves 20 when the outer ring 6 is placed in circumscribing alignment with the inner ring 5 such that the outer ring grooves 22 generally circumscribe and enclose the portion of the band 21 extending beyond the inner ring outer surface 15.

The bands 21 are preferably formed of an elastic polymer having a significantly higher coefficient of friction than the material of construction of the rings 5 and 6. Further, the bands 21 may be of various cross-sections including: square, rectangular, ovate or elliptical. Similarly the grooves 20 and 22 may be of corresponding cross-sections. Further, it is foreseeable that the bands 21 may alternatively be securable within the grooves 22 by various means including adhesive means such as gluing. It is also foreseen that the assembly may include more than two sets of aligned grooves 20 and 22 to receive more than two bands 21.

In use, material 2 is laid over the inner ring 5 such that the excess material extends over the outer surface 15 of the inner ring 5. The outer ring 6 is then positioned over and in circumscribing alignment with the inner ring 5 such that the material 2 extends between the outer surface 15 of the inner ring 5 and the inner surface 16 of the outer ring 6. The material 2 is generally pulled taut over the inner ring 5 and the nut 10 and bolt 9 on the clamp 7 are tightened to constrict the outer ring 6 around the inner ring 5 and around the material 2 extending therebetween. The material is compressed or constricted between the inner ring outer surface 15 and the outer ring inner surface 16 as well as between the bands 21 and the grooves 22 on the inner surface 16 of the outer ring 6. The increased coefficient of friction from the bands 21 and the tortuous path between which the material 2 is constricted enhance the gripping force of the inner and outer rings 5 and 6 on the material 2 to reducing slippage of material 2 through the rings 5 and 6 as various forces are applied to the material 2 secured therebetween during use.

FIG. 3 shows an alternative embodiment of the present invention having a single first groove 30 formed in an inner ring 31 on an outer surface 32 thereof. An elastic band 33 is securable within the groove 30. A single second groove 35 is formed in an outer ring 36 on an inner surface 37 thereof in alignment with the first groove 30 such that when the outer ring 36 is placed in circumscribing alignment with the inner ring 31 the outer ring groove 35 generally circumscribes and encloses the portion of the band 33 extending beyond the inner ring outer surface 32. It is foreseeable that the band 33 may be securable within the groove 35 by various means including adhesive means such as gluing.

FIG. 4 shows an alternative embodiment of the present invention having a single first groove 45 formed in an inner ring 46 on an outer surface 47 thereof. An elastic band 48 is securable within the groove 45. An outer ring 49 does not include a groove corresponding to the first groove 45 on the inner ring 46. It is foreseeable that the groove 45 may be formed in the outer ring 49 on an inner surface 50 thereof and that the band 48 may be securable within the groove 45 by various means including adhesive means such as gluing.

FIG. 5 shows an alternative embodiment of the present invention having a pair of first grooves 60 formed in an inner ring 61 on an outer surface 62 thereof. An elastic band 63 is securable within each of the grooves 60. An outer ring 64 does not include grooves corresponding to the grooves 60 on the inner ring 61. It is foreseeable that the grooves 60 may be formed in the outer ring 64 on an inner surface 65 thereof and that the band 62 may be securable within the grooves 60 by various means including adhesive means such as gluing.

FIG. 6 shows an alternative embodiment of the present invention. A ridge 70 is formed on an inner ring 71 on an outer surface 72 thereof and extends circumferentially around the inner ring 71. The ridge 70 has a cross-section which may generally be described as stepped rectangular. The ridge 70 shown in FIG. 6 generally includes two steps on either side of the ridge 70. It is foreseeable that the ridge 70 could include additional steps. A mating groove 75 of corresponding cross-section with the ridge 70 is formed in an outer ring 76 on an inner surface 77 thereof and extends circumferentially around the outer ring 76. The groove 75 is generally of slightly larger dimensions than the ridge 70. It is to be understood that the positions of the ridge 70 and groove 75 can be reversed such that the ridge 70 would extend circumferentially around the inner surface 77 of the outer ring 76 and the groove 75 would extend circumferentially around outer surface 72 of the inner ring 71.

FIGS. 7 through 10 show an alternative embodiment 79 of the craft hoop assembly of the present invention having a first groove 80 formed in an inner ring 81 on an outer surface 82 thereof. An elastic band 83 is securable within the groove 80. A second groove 85 is formed in an outer ring 86 on an inner surface 87 thereof in alignment with the first groove 80 such that when the outer ring 86 is placed in circumscribing alignment with the inner ring 81, the outer ring groove 85 generally circumscribes and encloses the portion of the band 83 extending beyond the inner ring outer surface 82.

A pair of apertures 90 (one of which is shown in FIG. 9) are formed in the inner ring 81 on opposite sides thereof. A portion of the band 83 is pushed through each of the apertures 90 against the biasing force of the band 83 to form a loop 91. A pin 92, which is longer than the diameter of the aperture 90, is positioned between the loop 91 and an inner surface 93 of the inner ring 81. The pin 92 is pressed against the inner surface 93 of the inner ring 81 by the biasing force of the band 83, and the pin 92 prevents the band 83 from retracting through the aperture 90. Securement of the band 83 to the inner ring 81 using pins 92 helps secure the band 83 in the groove 80 and prevents the band 83 from being pulled completely out of the groove 80.

Each pin 92 preferably has a midsection 95 of reduced diameter to prevent the pin 92 from slipping out of the loop 91. Material 99 on which a craft is to be performed is shown secured in the craft hoop assembly 79.

It is foreseen that more than two apertures could be formed in the inner ring 81 to accommodate a like number of loops 91 and pins 92. In addition, more than one band 83 could be secured to the inner ring 81 in corresponding grooves 80 using a similar loop 91 and pin 92 arrangement.

FIG. 11 shows an alternative embodiment of the craft hoop assembly 100 of the present invention having a groove 101 formed in an outer ring 102 on an inner surface 103 thereof. A projection 110 is formed on an outer surface 111 of an inner ring 112. The projection 110 is integrally formed on the inner ring outer surface 111 and sized, shaped and positioned such that the projection extends at least partially within the groove 101 in the outer ring 102 when the outer ring 102 is positioned in circumscribing alignment with the inner ring 112.

A coating 115 of friction enhancing material is bonded to the outer ring inner surface 103 and a coating 116 of friction enhancing material is bonded to the inner ring outer surface 111. The friction enhancing material preferably comprises a spray on or brush on pressure sensitive adhesive such is sold under the trademark Scotch-Grip by 3M Industrial Tape and Specialties Division. The Scotch-Grip brand product is also referred to as 4224-NF Clear and comprises water; acrylic polymer; poly(methyl methacrylate); sodium dodecylbenzenesulfonate; and ammonium hydroxide. The composition, after setting, provides a tacky and/or resilient coating which provides greater frictional resistance than the underlying inner and outer surfaces 103 and 111.

The coatings 115 and 116 of friction enhancing material grip material 117 positioned between the rings 102 and 112. The material 117 secured therebetween also must extend around projection 110 and into groove 101 which provides further securement of the material between the rings 102 and 112.

FIG. 12 discloses an alternative embodiment of the present invention, similar to the embodiment as shown in FIG. 11 wherein a groove 121 is formed in an inner ring 122 on an outer surface 123 thereof. A projection 130 is formed on an inner surface 131 of an outer ring 132. The projection 130 is integrally formed on the outer ring inner surface 131 and sized, shaped and positioned such that the projection extends at least partially within the groove 121 in the inner ring 122 when the outer ring 132 is positioned in circumscribing alignment with the inner ring 122.

A coating 135 of friction enhancing material is bonded to the outer ring inner surface 131 and a coating 136 of friction enhancing material is bonded to the inner ring outer surface 123. The coatings 135 and 136 are of similar composition as disclosed above. Material 140 on which a craft is to be performed is shown secured between the rings 122 and 132.

It is foreseen that with respect to either embodiment as shown in FIGS. 11 and 12 a coating of friction enhancing material might only be applied to one of the inner or outer ring surfaces. It is further foreseen that a wide variety of compositions might be suitable for use as friction enhancing material particularly compositions which permit spray on or brush on application. It is also foreseen that the projections 110 and 130 and the corresponding grooves 101 and 121 could be of varying cross-sections including semi-circular, rectangular, stepped rectangular or triangular.

It should also be noted that the relative dimensions of the fabric and the coatings of friction enhancing materials have been exaggerated to more clearly demonstrate the preferred embodiment.

It is to be understood that while certain forms of the present invention have been illustrated and described herein, it is not to be limited to the specific forms or arrangement of parts described and shown.

What is claimed and desired to be secured by Letters Patent is as follows:

1. A craft hoop assembly for securing material on which a craft is to be performed comprising:

(a) an inner ring having an outer surface;

(b) an outer ring having an inner surface and positionable in circumscribing alignment with said inner ring;

(c) said inner ring having a groove formed in and circumscribing said inner ring outer surface;

(d) an elastic band securable within said groove such that a portion of said band extends beyond said inner ring outer surface; and (e) said inner surface of said outer ring having a groove formed therein; said outer ring groove circumscribing said outer ring inner surface; said outer ring groove positioned on said outer ring in corresponding alignment with said inner ring groove such that said outer ring groove at least partially encloses said portion of said band extending beyond said inner ring outer surface from said inner ring groove.

2. The craft hoop assembly as in claim 1 further comprising:

(a) clamping means for adjusting the diameter of the outer ring for securing material on which a craft is to be performed between said inner and outer rings.

3. The craft hoop assembly as disclosed in claim 1 wherein said band is of circular cross-section and said inner ring groove and said outer ring groove are of semicircular cross-section.

4. The craft hoop assembly as disclosed in claim 1 wherein the diameter of said inner ring groove and said outer ring groove are slightly larger than the diameter of said elastic band.

5. A craft hoop assembly for securing material on which a craft is to be performed comprising:

(a) an inner ring having an inner surface and an outer surface;

(b) an outer ring having an inner surface and positionable in circumscribing alignment with said inner ring;

(c) said inner ring having a groove formed in and circumscribing said inner ring outer surface and at least one aperture extending from said groove through said inner ring; and (d) an elastic band securable within said groove such that a portion of said band extends beyond said inner ring outer surface and a section of said band extends through said aperture, around a pin positioned between said band and said inner ring inner surface, and back through said aperture, said pin preventing said band from retracting through said aperture.

6. The craft hoop assembly as in claim 5 further comprising:

(a) clamping means for adjusting the diameter of the outer ring for securing material on which a craft is to be performed between said inner and outer rings.

7. The craft hoop assembly of claim 5 wherein a pair of apertures extend from the inner ring groove through the inner ring on opposite sides of the inner ring and a section of said band extends through each of said apertures and around a pin positioned between the band and an inner surface of the inner ring adjacent each aperture; said pins preventing the band from retracting through said apertures.

8. The craft hoop assembly as in claim 5 wherein:

(a) said inner surface of said outer ring has a groove formed therein; said outer ring groove circumscribing said outer ring inner surface; said outer ring groove positioned on said outer ring in corresponding alignment with said inner ring groove such that said outer ring groove at least partially encloses said portion of said band extending beyond said inner ring outer surface from said inner ring groove.

9. The craft hoop assembly of claim 8 wherein said band is of circular cross-section and said inner ring groove and said outer ring groove are of semicircular cross-section.

10. The craft hoop assembly as disclosed in claim 9 wherein the diameter of said inner ring groove and said outer ring groove is slightly larger than the diameter of said elastic band.

11. A craft hoop assembly for securing material on which a craft is to be performed comprising:

(a) an inner ring having an outer surface;

(b) an outer ring having an inner surface and positionable in circumscribing alignment with said inner ring;

(c) a first of said inner ring and said outer ring having a groove formed in said outer surface or said inner surface respectively and extending circumferentially therearound;

(d) a second of said inner ring and said outer ring having a projection integrally formed on said outer surface or said inner surface respectively; said projection sized, shaped and positioned on said second ring such that said projection extends at least partially within said groove in said first ring when said outer ring is positioned in circumscribing alignment with said inner ring; and (e) a coating of tacky material bonded to said inner ring outer surface or said outer ring inner surface or both.

12. The craft hoop assembly as in claim 11 further comprising:

(a) clamping means for adjusting the diameter of the outer ring for securing material on which a craft is to be performed between said inner and outer rings.

13. A craft hoop assembly for securing material on which a craft is to be performed comprising:

(a) an inner ring having an outer surface;

(b) an outer ring having an inner surface and positionable in circumscribing alignment with said inner ring; and (c) a coating of tacky material secured to said inner ring outer surface or said outer ring inner surface or both.

14. The craft hoop assembly as in claim 13 further comprising:

(a) clamping means for adjusting the diameter of the outer ring for securing material on which a craft is to be performed between said inner and outer rings.

* * * * *